US005175965A

United States Patent [19]

Sanborn

[11] Patent Number: 5,175,965

[45] Date of Patent: Jan. 5, 1993

[54] METHOD FOR FORMING SANDPAPER DISKS

[75] Inventor: Kenneth R. Sanborn, Grosse Pointe Park, Mich.

[73] Assignee: Sandra L. Miller, Sterling Heights, Mich.

[21] Appl. No.: 632,524

[22] Filed: Dec. 24, 1990

[51] Int. Cl.[5] ..... B24D 3/00

[52] U.S. Cl. ..... 51/293; 51/295; 51/297

[58] Field of Search ..... 51/297, 295, 293

[56] References Cited

U.S. PATENT DOCUMENTS

| | | | |
|---|---|---|---|
| 1,965,719 | 7/1934 | Nelson | 154/40 |
| 2,128,739 | 8/1938 | Conner | 154/46 |
| 2,273,677 | 2/1942 | Wallach | 154/40 |
| 2,699,791 | 1/1955 | Hansen | 51/297 |
| 2,768,483 | 10/1956 | Hurst | 51/297 |
| 2,768,886 | 10/1956 | Twombby | 51/295 |
| 3,522,681 | 8/1970 | Lampert | 51/358 |
| 3,625,795 | 12/1971 | Knechtges | 156/291 |
| 3,805,475 | 4/1974 | Shimizu | 51/293 |
| 3,875,703 | 4/1975 | Clemente | 51/170 T |
| 4,380,092 | 4/1983 | Brothers | 15/209 |
| 4,617,767 | 10/1986 | Ali | 51/358 |
| 4,693,923 | 9/1987 | McGroarty et al. | 427/208.8 |
| 4,829,719 | 5/1989 | Braselton | 51/180 |

*Primary Examiner*—Mark L. Bell

*Assistant Examiner*—Willie J. Thompson

[57] ABSTRACT

A method and apparatus for forming sandpaper discs on a mass production basis. A roll of sandpaper and a roll of a velour fabric are mounted in a frame structure and are moved along separate feed paths to a pair of drive rollers where the webs are juxtaposed for subsequent movement through the apparatus as a laminated web. As the sandpaper web emerges from the sandpaper roll, it passes first beneath a heater where the upper face of the sandpaper is heated and thereafter beneath a spray assembly where adhesive is sprayed onto the heated upper face of the sandpaper with the heat energy in the sandpaper serving to evaporate the water soluble materials in the adhesive so that the sandpaper thereafter moving to the drive rollers is essentially dry so that the laminated web formed by the juxtaposition of the velour fabric and sandpaper at the drive rollers may thereafter be moved through the apparatus to a printing cylinder where grit indicia is applied to the exposed face of the velour fabric and thereafter to a die cutting station where a plurality of sandpaper webs are periodically stamped out of the laminated web. A spring biased take up roller and a slip clutch in the drive to the final drive rollers allows the web to pause momentarily and periodically as the sandpaper discs are cut from the web without interfering with the smooth continuous movement of the webs in the remainder of the apparatus.

9 Claims, 5 Drawing Sheets

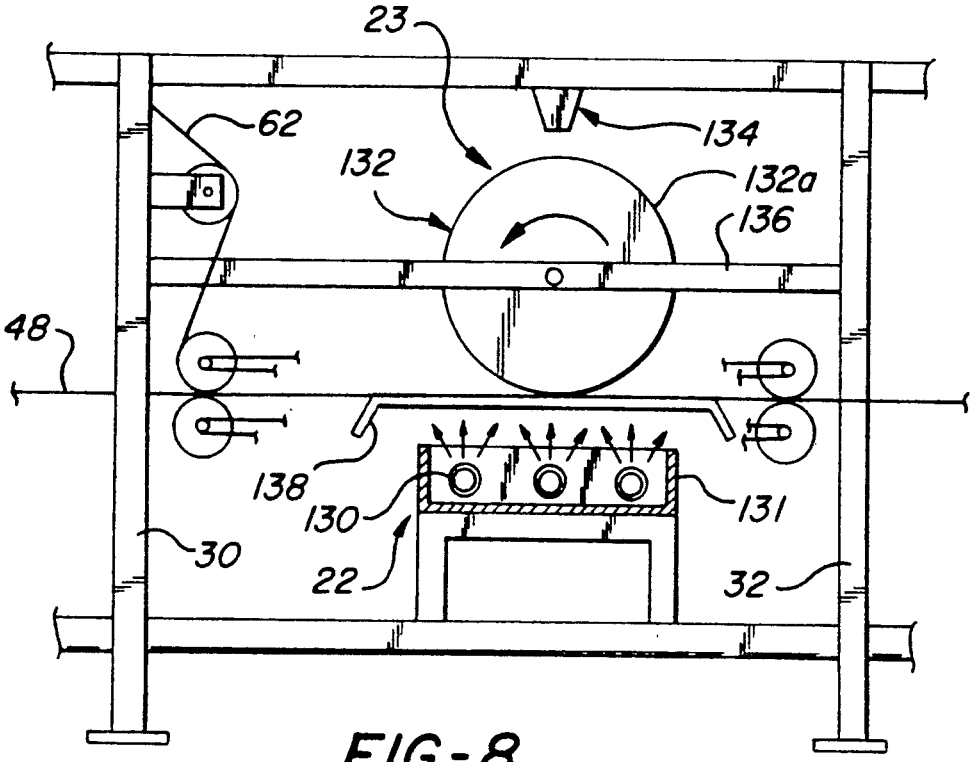
FIG-8
FIG-9
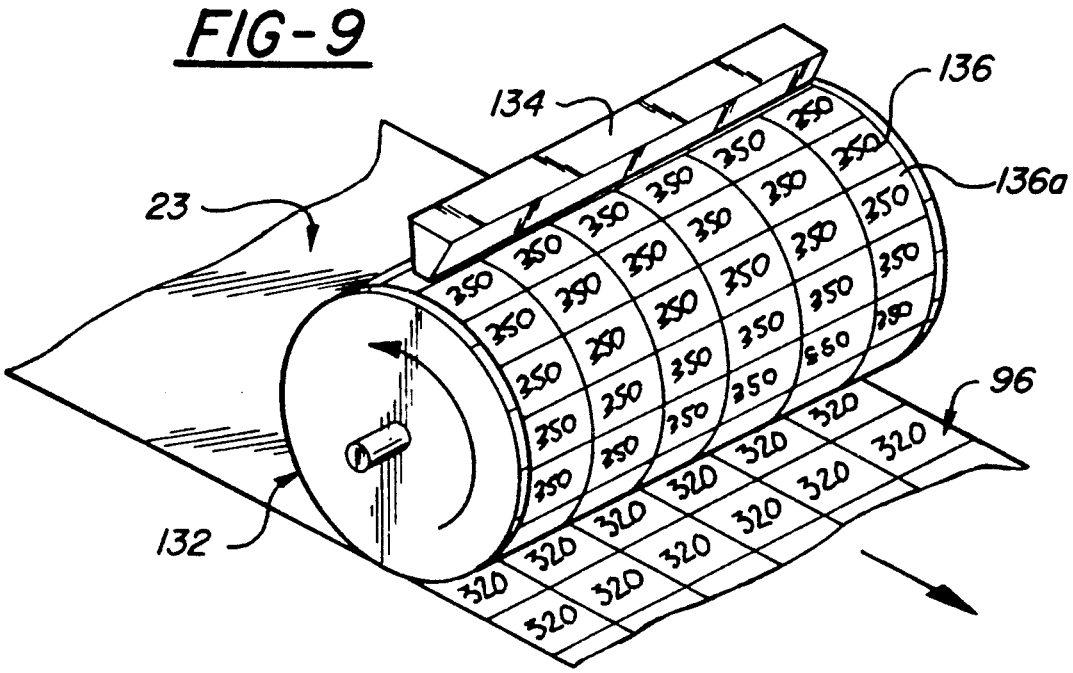

METHOD FOR FORMING SANDPAPER DISKS

BACKGROUND OF THE INVENTION

This invention relates to sandpaper and more particularly to a method and apparatus for producing sandpaper discs of the type including a sandpaper section and a section of a napped fabric secured to the sandpaper section.

Sandpaper is in widespread usage in industry whenever an abrasive action must be performed with respect to a material such as wood, steel or plastic. Typically the abrasive action is performed by attaching the sandpaper to a sanding device such as a rotary or reciprocating sander. In order to facilitate the replacement of a worn section of sandpaper with a fresh sandpaper section, it has become common practice to secure the sandpaper to the sander utilizing a hook and loop type fastener commonly known as a Velcro fastener and, specifically, it has become common practice to secure a hooked Velcro member to the sander and then secure a looped fabric to the smooth paper back of the sandpaper so that the sandpaper sections may be readily secured to and removed from the sander utilizing the hook and loop type fasteners provided by the Velcro member on the sander and the looped fabric member secured to the sandpaper. Various methods and apparatus have been proposed for the manufacture of the laminated sandpaper discs. These methods and apparatus have not been totally satisfactory since they have involved messy and environmentally derogatory procedures and since they have been relatively slow and inefficient with the result that the cost of producing the laminated sandpaper discs has been relatively high.

SUMMARY OF THE INVENTION

This invention is directed to the provision of an improved method and apparatus for producing sandpaper discs of the type including napped or looped fabric secured to the sandpaper to facilitate attachment and removal of the sandpaper pad from the associated sander.

The invention method is characterized in that a web of napped fabric is bonded to a web of sandpaper to form a laminated web, the laminated web is moved continuously along a path, and the moving laminated web is periodically pierced in a die cutting operation to periodically form a plurality of sandpaper discs. This arrangement provides a simple and inexpensive means of producing the laminated sandpaper discs.

According to a further feature of the invention methodology, prior to the bonding of the napped web to the sandpaper web, one face of the sandpaper web is heated and an adhesive material is thereafter applied to the heated face of the sandpaper web. The heat energy created in the sandpaper by the heating operation has the effect of evaporating the water soluble ingredients of the adhesive which is thereafter applied to the sandpaper web so that the sandpaper web leaving the adhesive station is essentially dry and may be thereafter pierced in a continuous die cutting operation.

According to a further feature of the invention methodology, grit indicia is provided on the exposed face of the napped fabric section of each sandpaper pad. In the disclosed embodiment of the invention methodology, the grit indicia is applied to the exposed face of the napped fabric web following the bonding operation and prior to the piercing operation so that each sandpaper pad formed in the piercing operation includes a grit indicia on the exposed face of the napped fabric section of the disc.

According to a further feature of the invention methodology, the length of the laminated web path between the bonding station and the piercing station is selectively varied to allow momentary and periodic stoppage of the web at the piercing station without interfering with the continuous movement of the web at the bonding station.

According to an important feature of the invention apparatus, the apparatus includes an elongated frame structure; rolls of napped fabric and sandpaper are mounted on one end of the frame structure; a die cutting apparatus is mounted on the other end of the frame structure; means are provided intermediate the ends of the frame structure to bond the web emerging from the sandpaper roll to the web emerging from the napped fabric roll to form a laminated web for delivery to the die cutting apparatus; a heater is positioned proximate the sandpaper path between the sandpaper roll and the bonding point; and an adhesive spray device is positioned proximate the sandpaper path between the heater means and the bonding point. This arrangement provides a simple and inexpensive apparatus for producing sandpaper discs in an efficient mass production manner.

According to a further feature of the invention apparatus, the apparatus further includes means positioned between the bonding means and the piercing means for applying a grit indicia to the exposed face of the napped fabric web. This arrangement provides a simple and inexpensive means for insuring that each sandpaper disc is marked with a grit indicia that is readily visible to the user.

BRIEF DESCRIPTION OF THE DRAWINGS

FIGS. 8 and 9 are detailed views of the grit indicia assembly utilized in the invention apparatus.

DETAILED DESCRIPTION OF THE PREFERRED EMBODIMENT

Figures 1, 5:
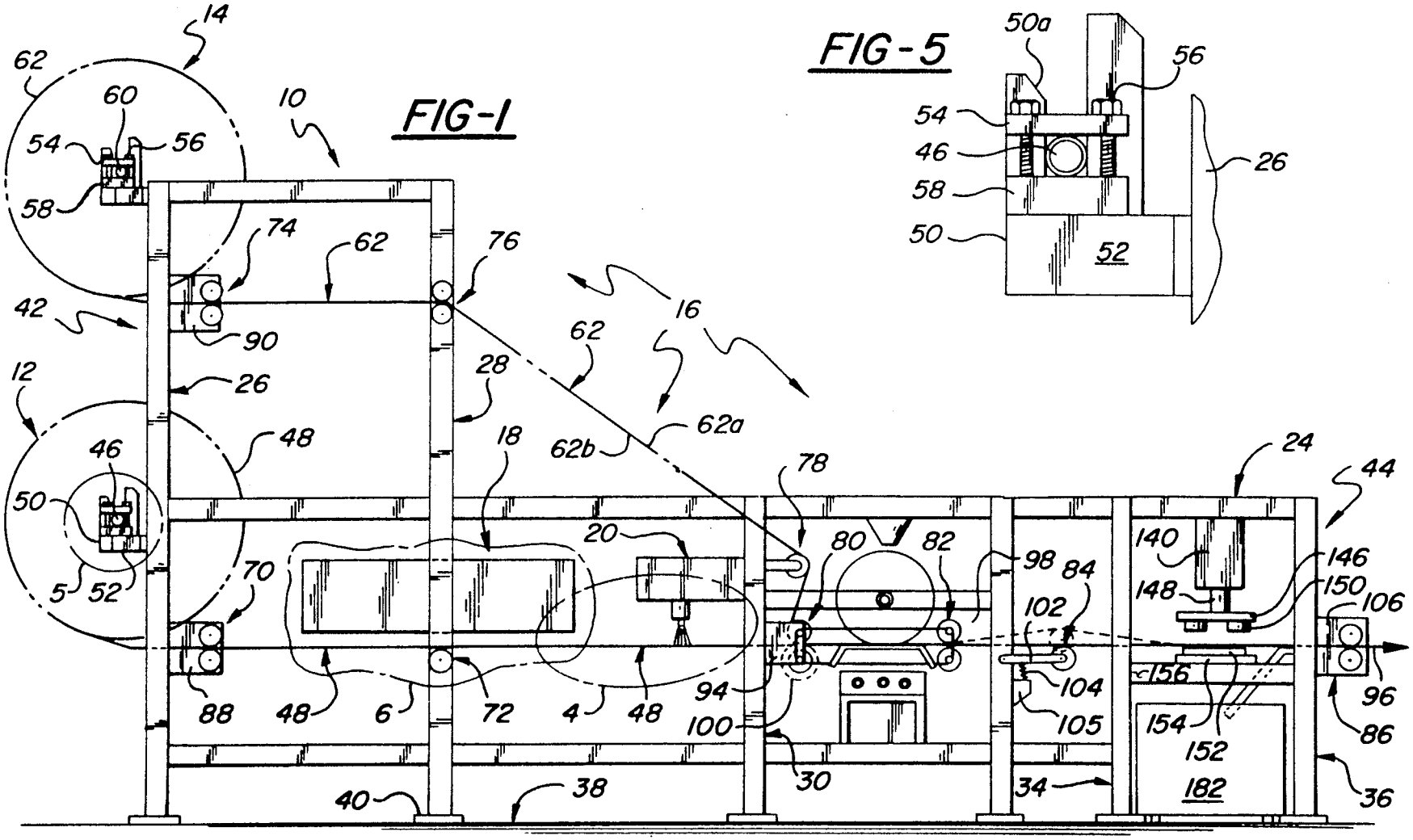
FIG. 1 is a side elevational view of the invention apparatus.
FIGS. 4, 5, and 6 are detailed views taken respectively within the circles 4, 5, and 6 of FIG. 1.
Figure 2:
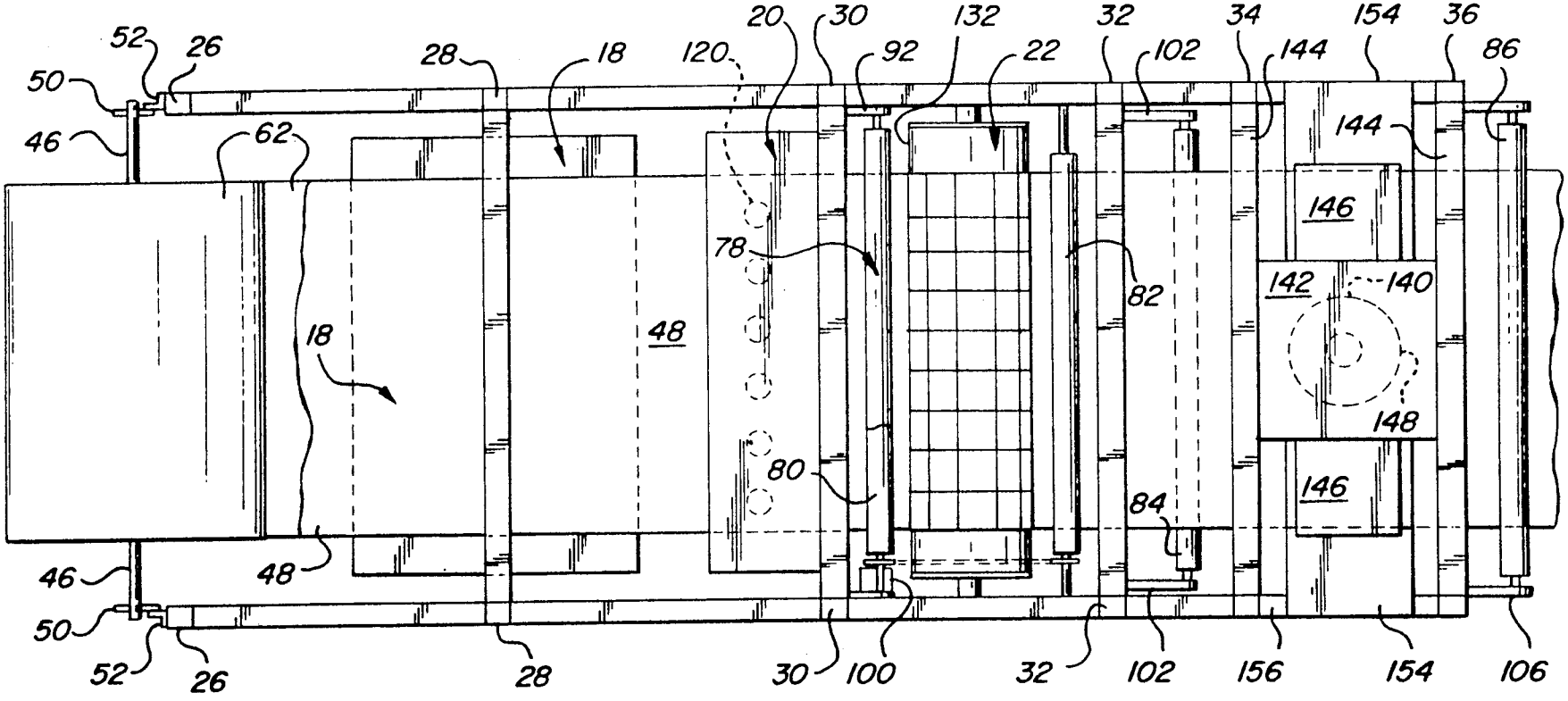
FIG. 2 is a top view of the invention apparatus.

The invention apparatus, broadly considered, includes a frame 10, a sandpaper roll 12, a velour fabric roll 14, a roller system 16, a heater 18, a spray assembly 20, an auxiliary temperature control device 22, a grit indicia assembly 23, and a die cutting assembly 24.

Frame 10 is of steel tubular construction and includes a plurality of laterally spaced pairs of pillars 26,28,30,32,34,36 connected by suitable lateral and longitudinal brace members to form a unitary rigid structural frame assembly. Frame 10 is supported on a suitable support surface 38 by feet 40 secured to the lower ends of the various pillars. Frame 10 is of a welded construction and defines a feed or input end 42 and a discharge or delivery end 44.

Sandpaper roll 12 comprises a spindle 46 and a roll of sandpaper 48 suitably wrapped around the spindle. Spindle 46 is suitably journalled at its opposite ends in upwardly opening slots 50*a* defined by brackets 50 secured to angle irons 52 secured to pillars 26. A braking bar 54 frictionally engages the upper face of each end of the spindle 46 and applies an adjustable braking action to the spindle by selective tightening of bolts 56 passing through spaced bores in braking bar 54 and threadably engaging at their lower ends in blind threaded bores provided in a block member 58 secured to each bracket 50.

Sandpaper 48 includes an abrasive side 48*a* formed in known manner of abrasive sand particles and a smooth paper side 48*b*. Sandpaper 48 is wrapped around spindle with the abrasive side 48*a* disposed radially outwardly.

Velour fabric roll 14 includes a spindle 60 journalled at its opposite ends in the slots 50*a* of brackets 50 secured by angle irons 52 to the upper ends of pillars 26. A braking assembly 54,56,58 is associated with the spindle 60 so that the braking of velour roll 14 may be selectively controlled in the manner described with respect to sandpaper roll 12. A velour fabric 62 is wrapped around spindle 60. Velour fabric 62 may take various forms but must have a napped finish so as to provide the loop configuration for coaction with the hook configuration provided by a Velcro member secured to a sander.

Roller assembly 16 includes a plurality of rollers for selectively guiding and driving the sandpaper web 48, the velour fabric web 62, and the combined web in their movement through the apparatus. Roller system 16 includes a pair of guide rollers 70; a guide roller 72; a pair of guide rollers 74; a pair of guide rollers 76; a guide roller 78; a pair of drive rollers 80; a pair of drive rollers 82; a take up roller 84; and a pair of drive rollers 86.

Guide rollers 70 are mounted on brackets 88 secured to pillars 26 and engage the opposite sides 48*a*, 48*b* of the sandpaper web leaving the roll 12.

Guide roller 72 is mounted between pillars 28 and engages the underface 48*a* of the sandpaper web moving between pillars 28.

Guide rollers 74 are mounted to pillars 26 by brackets 90 and engage the upper and lower faces 62*a*,62*b* of the velour fabric web leaving the roll 14.

Guide rollers 76 are mounted between pillars 28 and engage the upper and lower faces 62*a*,62*b* of the velour fabric web as it passes between the spaced pillars 28.

Guide roller 78 is secured to pillars 30 by brackets 92 and wrappingly engages the lower face 62*b* of the velour fabric web proximate the pillars 30.

Drive rollers 80 are mounted on brackets 94 secured to pillars 30 and are positioned directly beneath guide roller 78. Drive rollers 80 respectively engage the upper face 62*a* of velour fabric web 78 and the lower face 48*a* of sandpaper web 48 and nip or pinch the webs together to form a laminated compound web 96 in which the underface 62*b* of the velour fabric web is juxtaposed to the upper face 48*b* of the sandpaper web.

Driver rollers 82 are mounted to pillars 32 by brackets 98 and respectively engage the upper and lower faces of the laminated web 96 proximate the pillars 32.

Suitable means are provided for positively driving rollers 80 and 82. For example, and as shown, an electric motor 100 may drivingly engage one end of the lower roller of the roller pair 80 with suitable chain and sprocket members interconnecting the upper roller of the roller pair 80 and both rollers of the roller pair 82 so that all of the rollers may be suitably driven from the electric motor 100 with the upper rollers rotating in a counter-clockwise direction and the lower rollers rotating in a clockwise rotation so as to cooperate to drive the laminated web from left to right as viewed in FIG. 1.

Slack roller 84 is pivotally mounted on pivot arms 102 pivotally secured to respective pillars 32 with springs 104 mounted on brackets 105 urging the arms 102 and thereby the roller 84 upwardly against the lower face of the laminated web 96.

Drive rollers 86 are mounted on brackets 106 secured to pillars 36 and are driven by a separate motor and gear arrangement (not shown) in which the drive means includes a slipping clutch so as to allow the rollers to slip relative to the laminated web 96 as such times as the movement of the laminated web therebetween is momentarily halted.

Figure 6:
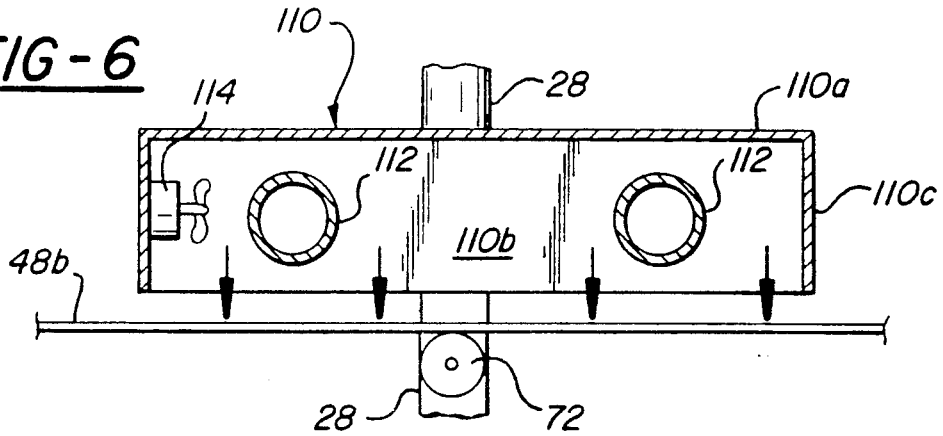

Heater 18 is secured between pillars 28 and, as best seen in FIG. 6, includes a sheet metal hood 110, a pair of conduits 112 extending transversely through the hood, and a fan or blower 114 positioned within the hood. Hood 110 includes a top 110*a*, longitudinal sides 110*b*, and lateral sides 110*c* and is open at its lower face so that heat radiated from tube 112 in response to the passage of a heated fluid through the tubes is directly downwardly onto the upper face 48*b* of the sandpaper web passing therebeneath with the air movement within the hood being facilitated by the operation of the blower 114.

Figure 4:
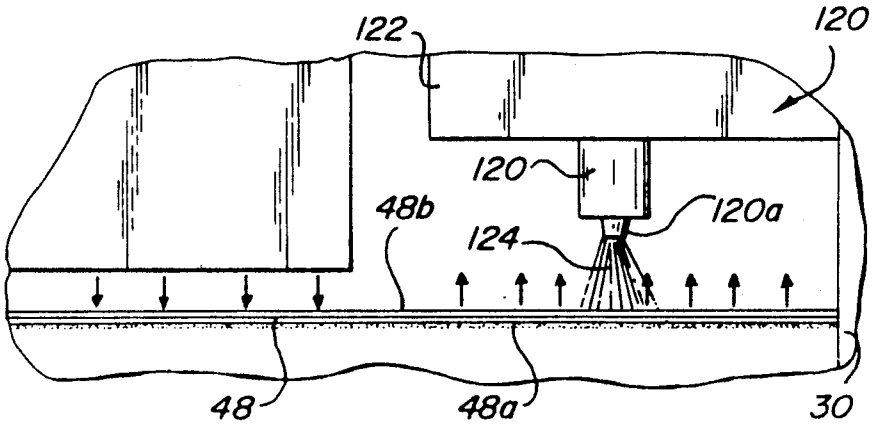
Figure 3:
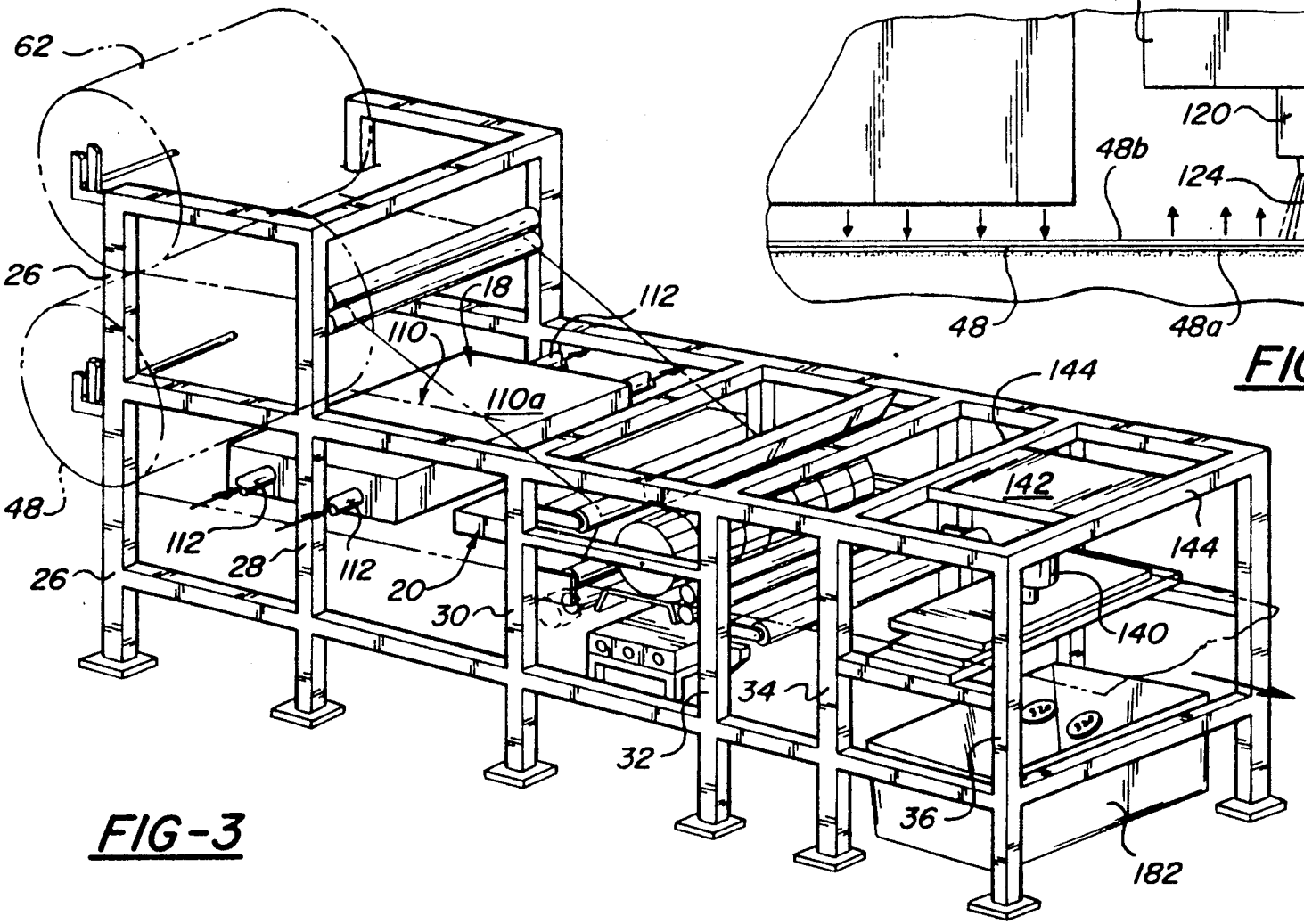
FIG. 3 is a perspective view of the invention apparatus.

Spray assembly 20, as best seen in FIG. 4, includes a plurality of spray guns 120 communicating with a plenum 122 suitably secured to pillars 30. Spray guns 120 are provided at laterally spaced locations across the entire breadth of the sandpaper path and a plurality of rows of spray guns 120 are provided at longitudinally spaced locations along the path. Spray guns 120 may, for example, be of the type available from Binks-Graco of Chicago, Illinois as Item No. Mach I HELP and operate in known manner in conjunction with a source of compressed air and a source of adhesive so that the air and adhesive may be delivered to the plenum where it may be preheated and distributed to the individual spray guns 120 so as to provide a preheated adhesive spray 124 emanating from the discharge nozzles 120*a* of the spray guns so that the spray guns, in combination, provide a sprayed on adhesive coating across the entire width of the smooth or upper paper face 48*b* of the sandpaper web passing therebeneath.

The adhesive may take various forms but preferably is a water based resin glue of the type available, for example, from Swift Adhesives of Chicago, Ill.

Auxiliary temperature control device 22 is mounted by the frame 10 in a position between pillars 30 and 32 and in underlying relation to the laminated web 96 between drive rollers 80 and drive rollers 82. Auxiliary device 22 may, for example, comprise a plurality of longitudinally spaced tubes or conduits 130 extending within a hood 131 in transverse relation to the laminated web path and including a plurality of distributor holes at spaced locations in and along the tubes so that a heated fluid such as air passing through the tubes will pass outwardly and upwardly through the distributor holes in the tubes and impinge on the lower face of the laminated web 96. Depending upon the application, the auxiliary device 22 may have a heating or cooling effect with respect to the laminated web with the type of action imparted to the web determined by the nature and temperature of the fluid passed through the conduits 130.

Grit indicia assembly 23 includes a printing cylinder or a roller 132 and an ink reservoir 134.

Printing cylinder or roller 132 is suitably journalled at its opposite ends in frame members 136 extending between pillars 30 and 32 with its outer circumference or periphery 132*a* in contiguous relation to the upper face 62*a* of the velour fabric web 62 of laminated web 96. Roller 132 includes a plurality or matrix of grit indicia 136 on the circumference 132*a* of the cylinder. Cylinder 132 functions to imprint indicia 136 on the upper face 62*a* of velour fabric web 62 as the velour fabric web moves, as part of laminated web 96, between drive rollers 80 and driver rollers 82. Indicia 136 have a lateral and circumferential spacing on the circumference of the cylinder chosen to ensure that each sandpaper disc cut from the laminated web will include an indicia 136 on the upper or exposed face of the velour fabric section of the sandpaper disc. The indicia on the cylinder 132 may be provided in many ways depending upon the particular printing process employed to apply the indicia to the upper face of the velour fabric and may, for example, comprise letter symbology, offset indicia, or etched indicia. A rigid table 138 is positioned in underlying relation to the laminated web 96 moving between rollers 80 and 82 to provide a positive undersupport for the web and provide a backing surface to facilitate the indicia applying process.

Reservoir 134 is suitably supported on frame 10 in a position overlying cylinder 132, is filled with a suitable ink material, and functions in known manner to distribute ink onto the circumference 132*a* of the cylinder in a continuous manner so as to ensure that indicia are continuously applied to the upper face of the velour fabric of the laminated web moving beneath the cylinder 132. It will be understood that cylinder 132 is rotated in the direction of the arrow by any suitable drive means, not shown.

Figure 7:
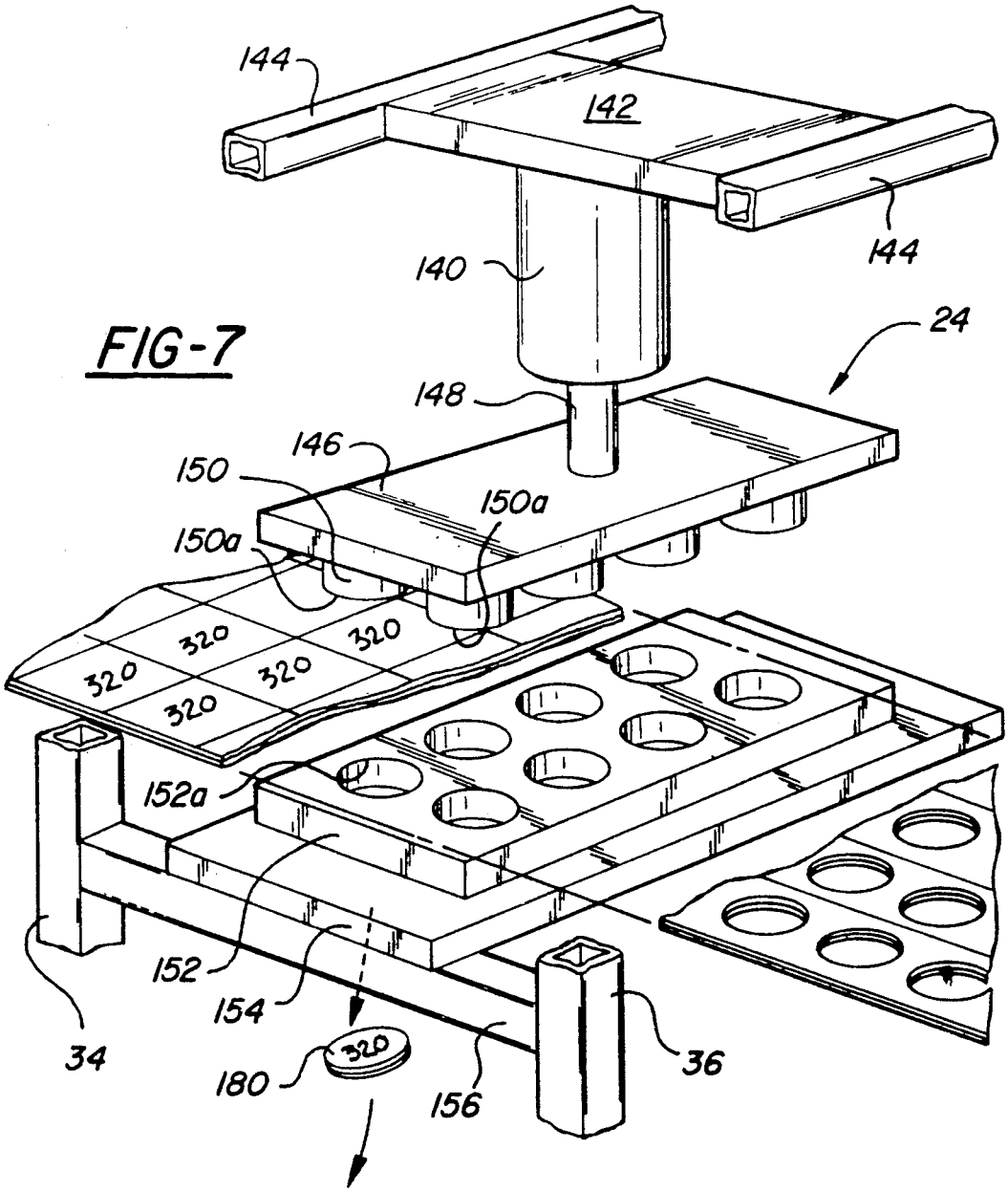
FIG. 7 is a detailed view of the die cutting assembly utilized in the invention apparatus.

Die cutter assembly 24, as best seen in FIG. 7, includes a fluid cylinder 140 secured to and extending downwardly from a plate 142 positioned between lateral members 144 of frame 10, an upper platen 146 secured to the lower end of the piston rod 148 of the cylinder, an upper steel rule die 150 secured to the lower face of platen 146, and a lower die plate 152 secured to a lower platen 154 carried by frame members 156 extending between pillars 34 and 36. Steel rule die 150 includes a plurality of die sections 150*a* with the shape of each die section depending on the desired shape of the final sandpaper pad to be cut out of the laminated web. As shown, the steel rule die sections 150*a* are circular and cooperate with correspondingly sized circular apertures 152*a* in lower die plate 152 so that, in response to downward movement of the upper platen into coaction with the lower platen, the steel rule die sections 150*a* selectively enter the apertures 152*a* to selectively pierce or cut a plurality of circular sandpaper discs 180 from the laminated web 96.

The apparatus further includes a bin 182 positioned between pillars 34 and 36 in underlying relation to the die cutter apparatus 24 to collect the sandpaper discs 180 cut from the laminated web 96.

In operation, guide roller 70,72 coact with the driver rollers 80 to define a sandpaper feed path extending between the sandpaper roll 12 and the guide rollers 80 in underlying relation to the heater 18 and the spray system 20; guide roller 74,76 and 78 cooperate with drive rollers 80 to define a velour fabric feed path extending from the velour fabric roll 14 in overlying relation to the heater 18 and spray assembly 20 to the drive rollers 80; and the drive rollers 80 and 82 coact with the take up roller 84 and drive rollers 86 to define a laminated web feed path extending from the drive rollers 80 to the drive rollers 86. The speed at which the sandpaper and velour fabric webs, and the combined laminated web, move through the machine, and the tension imposed on the various webs, is selectively determined by selective adjustment of the brake bars 54 engaging the spindles of the sandpaper and velour fabric rolls, by selective adjustment of the speed of the drive motor 100, by selective adjustment of the springs 104 biasing the take up roller 84 against the underface of the laminated web, and by selective adjustment of the slip clutch incorporated in the drive for the final drive rollers 86.

As will be apparent, as the sandpaper web leaves the sandpaper roll and passes between guide rollers 70 and beneath heater 18, the smooth upper face 48*b* of the sandpaper is radiantly heated by the action of the heated fluid passing through conduits 112, whereafter the heated sandpaper web is passed beneath the spray assembly 20 where the spray heads 120*a* act to deposit a smooth, complete and uniform coating of preheated adhesive to the heated upper face of the sandpaper web, whereafter the heated and adhesively coated sandpaper meets the velour fabric unwinding from the velour fabric roll 14 at the drive rollers 80 where it is adhesively bonded to the velour fabric to form the laminated web 96 which thereafter passes through drive rollers 82 and over take up roller 84 for passage through die cutter assembly 24.

As the laminated web 96 moves between rollers 82 and 84 cylinder 132 acts in conjunction with reservoir 134 to apply the grit indicia 136 to the upper face of the velour fabric in a matrix pattern corresponding to the matrix pattern defined by steel rule die sections 150*a* of the die cutter assembly 24.

As the web moves between drive rollers 82 and 84, temperature control device 22 functions to either heat or cool the web depending upon the requirements of the particular application. It will be understood that table 138 is perforated to facilitate the passage of a heating or cooling medium upwardly therethrough for access to the laminated web.

As the laminated web passes beneath the die cutter assembly, the cylinder 140 is intermittently actuated to intermittently drive the platen 146 and thereby the steel rule die 50 downwardly into engagement with the laminated web to cut the sandpaper discs 180 from the web. As the steel rule die is moved through the web and coacts with the apertures 152*a* to cut out the sandpaper discs, the web is momentarily stopped by the clamping and gripping action of the die cutting apparatus but this momentary, periodic stoppage of the web is accommodated by the take up roller 84 and by the slip clutch provided in the drive for the drive rollers 86. Specifically, as the web is momentarily and periodically gripped between the upper and lower platens of the die cutting apparatus, the roller 84 is moved upwardly by the springs 104 to increase the length of the path between the drive rollers 82 and the die cutting apparatus and thereby take up the slack in the system and allow the drive rollers 80 and 82 to continue operating without interruption and to allow the laminated web 96 to continue to move smoothly and uninterruptedly through the apparatus, and the slip clutch in the drive to the drive rollers 86 allows the rollers 86 to momentarily slip relative to the web as the web is momentarily stopped by the gripping action of the die cutting apparatus whereafter, following the upward movement of the die cutting apparatus to release the web, the drive rollers 86 grip the web and move the web in an accelerating manner to move the take up roller 84 downwardly to its initial position preparatory to a new die cutting operation. Accordingly, the laminated web between the rollers 82 and die cutting apparatus intermittently assumes the straight solid line path shown in FIG. 1 and the dotted line tented path shown in FIG. 1 and the cut web leaving the die cutting apparatus intermittently slips between the drive rollers 82 by virtue of the slip clutch in the drive to the rollers 86 and is thereafter accelerated by the drive rollers 86 to take the slack out of the system and move the slack roller 84 down to its solid line position. The perforated laminated web 96 leaving the drive rollers 86 is suitably transported to a discharge or disposal point.

It will be understood that the timing of the die cutter apparatus in conjunction with the speed or movement of the laminated web through the apparatus is such that there is no significant amount of web material between the areas of the web acted upon by the successive downward movements of the die cutting apparatus so that essentially all of the web is utilized in forming the sandpaper discs 180.

It will be seen that the invention apparatus provides a means of manufacturing sandpaper discs on a continuous, inexpensive, mass production basis. It will be understood that the combined action of the heater 18 and the spray assembly 20 is critical to the successful continuous operation of the invention apparatus and that, specifically, the heat energy imparted to the sandpaper by virtue of the heater 18 acts to evaporate the water based solubles in the adhesive applied by the spray assembly 20 so that the sandpaper web leaving the spray assembly 20 is essentially dry and therefore may be immediately imprinted with indicia by the indicia assembly and cut by the die cutter apparatus following its bonding to the velour fabric. It will be understood that a wet laminated web would be virtually impossible to imprint or to cut and that the amount of heat imparted to the sandpaper web is selectively adjusted relative to the amount of adhesive applied by the spray assembly 20 to ensure that the sandpaper fabric leaving the spray system is essentially dry to thereby ensure the success of the imprinting and die cutting operation. It will be further understood that the preheating of the adhesive spray emanating from the spray guns augments the heat applied to the web by the heater 18 to further facilitate the evaporation of the water based solubles in the adhesive and further ensure that the sandpaper fabric leaving the spray system is essentially dry.

Whereas a preferred embodiment of the invention has been illustrated and described in detail, it will be apparent that various changes may be made in the disclosed embodiment without departing from the scope or spirit of the invention.

I claim:

1. A method comprising a napped looped fabric section secured to a sandpaper section characterized in that one face of a moving web of sandpaper is heated, an adhesive material is thereafter sprayed on said one heated face of the moving web of sandpaper, a moving web of looped napped fabric is adhesively bonded to the moving web of sandpaper to form a laminated web, the laminated web is moved continuously along a path, the moving laminated web is passed through a heating station at which heat is applied to the web to remove moisture imparted to the web by the adhesive, and the moving laminated web is thereafter periodically pierced in a die cutting operation to periodically form a plurality of sandpaper discs.

2. A method according to claim 1 characterized in that the length of the laminated web path between the bonding station and the piercing station is selectively varied to allow momentary and periodic stoppage of the web at the piercing station without interfering with the continuous movement of the web at the bonding station.

3. A method of forming a laminated sandpaper and napped looped fabric product characterized in that a moving web of napped looped fabric is bonded to a moving web of sandpaper and, prior to the bonding step, one face of the sandpaper web is heated and an adhesive is thereafter sprayed onto the heated face of the sandpaper web.

4. A method according to claim 3 characterized in that the adhesive is a water-based adhesive and the parameters of the heating step and the adhesive spraying step are controlled such that the hat energy created in the sandpaper web has the effect of evaporating the water and water solubles in the adhesive so that the web leaving the adhesive applying station is essentially dry.

5. A method according to claim 4 characterized in that grit indicia is applied to the exposed face of the napped fabric following the bonding step.

6. A method according to claim 4 characterized in that the moving laminated web leaving the bonding station is passed through a heating station to further dry the web.

7. A method of forming a plurality of laminated sandpaper discs each including a looped napped fabric section secured to a sandpaper section and including indicia of the sandpaper grit, characterized in that a moving web of sandpaper is adhesively bonded to a moving web of fabric to form a laminated web and the grit indicia is applied in a printing operation to the exposed face of the moving web of looped napped fabric.

8. A method according to claim 7 characterized in that the sandpaper discs are pierced from the laminated web, the grit indicia is applied in serial repetitive fashion to the exposed face of the looped napped fabric web prior to the piercing operation, and the piercing operation is timed such that each pierced disk has a grit indicia thereon.

9. A method according to claim 8 characterized in that the grit indicia is applied to the exposed face of the napped fabric web following the bonding operation.

* * * * *

UNITED STATES PATENT AND TRADEMARK OFFICE

CERTIFICATE OF CORRECTION

PATENT NO. : 5,175,965

DATED : January 5, 1993

INVENTOR(S) : Hook "N" Sand

It is certified that error appears in the above-identified patent and that said Letters Patent is hereby corrected as shown below:

Column 8, Line 1, after "method" insert --of forming a plurality of laminated sandpaper discs--

Column 8, Line 31, Delete "hat" Insert --heat--

Signed and Sealed this

Twenty-eighth Day of December, 1993

*Attest:*

Bruce Lehman

BRUCE LEHMAN

*Attesting Officer*

*Commissioner of Patents and Trademarks*